United States Patent [19]

Kowols

[11] 4,152,705

[45] May 1, 1979

[54] ADJUSTABLE TOP LOADED ANTENNA

[75] Inventor: Gilbert J. Kowols, Park Ridge, Ill.

[73] Assignee: Anixter Bros., Inc., Skokie, Ill.

[21] Appl. No.: 757,907

[22] Filed: Jan. 10, 1977

[51] Int. Cl.[2] ..... H01Q 9/18

[52] U.S. Cl. ..... 343/750; 343/715

[58] Field of Search ..... 343/745, 750, 703, 749, 343/901, 903, 711–715

[56] References Cited

U.S. PATENT DOCUMENTS

| | | | |
|---|---|---|---|
| 2,966,679 | 12/1960 | Harris | 343/895 |
| 3,380,062 | 4/1968 | George | 343/903 |
| 3,541,558 | 11/1970 | Rhein | 343/901 |

*Primary Examiner*—Alfred E. Smith
*Assistant Examiner*—David K. Moore
*Attorney, Agent, or Firm*—Charles F. Pigott, Jr.

[57] ABSTRACT

An adjustable mobile antenna comprising an upper metal mast and a lower metal mast, the upper mast being telescopically received in the lower mast and adjustably movable longitudinally therein to vary the length of the antenna and thereby effect tuning thereof, a clamping member for releasably locking the upper mast in a selected position relative to the lower mast, a dielectric rod extending upwardly from the upper end of the upper metal mast, and a loading coil helically wound on the dielectric rod with a lower end of the coil connected to the upper metal mast adjacent the upper end thereof, and a protective outer jacket covering the loading coil, the antenna being tunable by simply adjusting its length.

10 Claims, 3 Drawing Figures

ADJUSTABLE TOP LOADED ANTENNA

BRIEF SUMMARY OF THE INVENTION

The present invention relates to an adjustable mobile antenna for use on automobiles, trucks, boats and the like, and in particular to a fully adjustable, top loaded antenna.

It is known in the art to provide a top loaded antenna, and it is also known to provide an antenna which can be tuned in the field. However, most tunable antenna are tuned by electrical adjusting means, as for example, by varying an inductance, or by shorting out a certain number of turns of the loading coil. In addition, where known antennas are tuned by adjusting the length thereof, the usual procedure is to provide an adjustable metal extension which can be drawn out beyond the end of the loading coil. However, when such an extension is utilized, the antenna is no longer truly top loaded, since the loading coil is not wound on the extendable metal tip member.

It is a general object of the present invention to provide a variable length mobile antenna which is unusually durable in its construction, exceptionally easy to tune, and which remains top loaded throughout its range of adjustment.

Another object of the invention is to provide a top loaded antenna of the foregoing type which comprises an upper metal mast adjustably telescoped into a lower metal mast, and a dielectric rod extending from the upper end of the upper metal mast with a loading coil helically wound on the dielectric rod.

Still another more specific object of the invention is to provide a mobile antenna as last above mentioned including a split collet formed at the upper end of the lower metal mast in conjunction with an internally threaded ferrule member which clamps the collet to releasably lock the upper metal mast in a selected position relative to the lower metal mast.

The foregoing and other objects and advantages of the invention will be apparent from the following description of a preferred embodiment, taken in conjunction with the accompanying drawings.

Now, in order to acquaint those skilled in the art with the manner of making and using my invention, I shall describe, in conjunction with the accompanying drawings, a preferred embodiment of the invention.

DETAILED DESCRIPTION OF THE INVENTION

Figure 1:
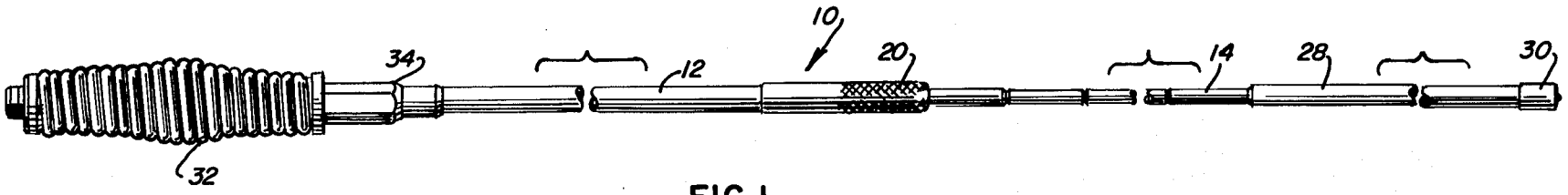
FIG. 1 is an elevational view of an antenna, constructed in accordance with the present invention, showing the antenna associated with a spring type mounting member.

In the following description, the terms "upper" and "lower" are used with reference to the intended mounting of the antenna in a vertical manner. Thus, the right hand end of the antenna as shown in FIGS. 1 and 2 will be referred to as the "upper" end of the antenna, and the left hand end as shown in the foregoing drawings will be referred to as the "lower" end of the antenna.

Figure 3:
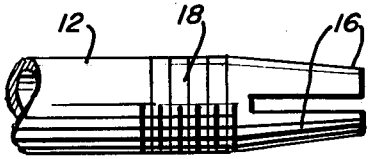
FIG. 3 is an enlarged fragmentary view of the upper end of the lower mast of the antenna, showing an inwardly tapered split collet formed thereon.

Referring now to the drawings, there is shown an antenna 10 comprising a lower metal mast 12 and an upper metal mast 14, the upper mast 14 being telescopically received within the lower mast 12 which is formed as a hollow tubular member. As best shown in FIG. 3, the upper end of the lower mast 12 is tapered inwardly and comprises a split collet including four inwardly tapered fingers 16, and immediately below the tapered collet the lower mast has a threaded portion 18 for cooperation with an internally threaded ferrule or sleeve 20.

The ferrule 20 is a hollow tubular member which is mounted over the solid upper mast 14 and threaded on to the upper end of the lower mast 12. The ferrule 20 is internally tapered outwardly at its lower end for cooperation with the tapered collet fingers 16, whereby when the ferrule 20 is threaded downwardly on the upper end of the lower mast 12, the ferrule clamps inwardly on the collet fingers 16 and causes the latter to tightly grip the upper mast 14. It will thus be understood that in order to adjust the length of the antenna 10 and thereby tune the same, it is only necessary to loosen the ferrule 20, whereby the extent to which the upper mast 14 is telescoped within the lower mast 12 may be adjusted as desired, after which the ferrule may be threaded down on the lower mast 12 to releasably lock the upper mast 14 in a selected position relative to the lower mast 12.

Figure 2:
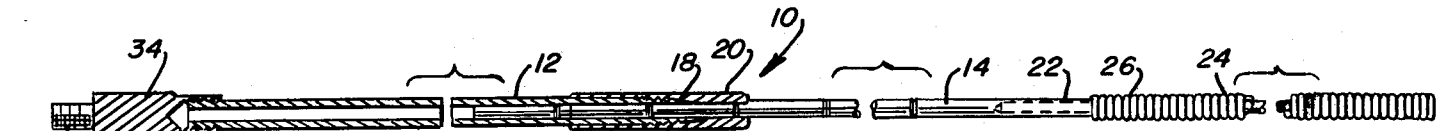
FIG. 2 is a view of the antenna of FIG. 1, showing the lower mast in section, and showing the upper mast with a protective jacket removed to illustrate a helical loading coil.

As best shown in FIG. 2, the upper end of the upper mast 14 includes a hollow tubular section 22 in which is mounted the lower end of a dielectric rod 24. Thus, the rod 24 forms the upper end portion of the antenna 10 and serves as a base on which a loading coil 26 is helically wound. It will be seen that the loading coil 26 is wound on the entire exposed length of the rod 24 from the extreme upper end thereof down to the point where the rod 24 is telescoped into the hollow upper end 22 of the upper mast 14. The rod 24 is fixedly mounted in the upper end of the upper mast 14 in a permanent fashion, as no adjustment in the relative positions of the rod 24 and upper mast 14 is intended.

It will further be noted that, in accordance with a preferred embodiment, the loading coil 26 is wound with the turns against one another to provide minimum pitch and thereby achieve the maximum number of turns for a given length of the rod or base 24. The lower end of the loading coil 26 is then soldered to the outside of the upper mast 14 adjacent the upper end thereof, it being understood that it is not necessary to extend an end of the loading coil along the length of the masts 14 and 12, since both of the masts are metal and thus electrically conductive.

An insulating jacket or cover 28 is heat shrunk or otherwise formed (see FIG. 1) on the outside of the loading coil 26, and preferably the jacket extends for a short distance over the upper end of the upper mast 14 to cover the point where the loading coil 26 is soldered to the upper mast. A plastic cap 30 may be applied to the extreme upper end or tip of the antenna 10 over the insulating jacket 28.

The antenna 10 of the present invention may be mounted by various conventional mounting members, and, by way of example, a known form of spring mount is shown at 32 in FIG. 1. A base ferrule 34 is threaded to the lower end of the hollow tubular lower mast 12, and the base ferrule includes a threaded stud 36 for mounting the antenna in the spring mount 32.

It is a feature of the present invention that both the upper and lower masts are made of conductive metal, although various metals may be utilized. In accordance with one preferred form of the invention, the masts 12 and 14 are made of chromeplated brass. The upper rod or shaft 24 is made of a flexible, dielectric material which is resilient and light weight, and, in accordance with a preferred embodiment, the rod 24 is made of fiberglass.

The foregoing antenna offers unique advantages over previously known mobile antennas. It is fully adjustable in the field by simply loosening the ferrule 20 and varying the extent by which the upper mast 14 telescopes into the lower mast 12, after which the ferrule 20 is tightened. By the foregoing simple expedient, there is provided full adjustment for top performance on all channels, including new channels as they are released. Moreover, since no adjustment occurs at the upper end of the upper mast 14, the antenna remains in its top loaded mode in all positions of adjustment.

In accordance with one specific form of the invention, the antenna 10 may be manufactured to a height of 54 inches when fully extended, and it provides a tuning range of 26.9–27.5 MHz. In accordance with the latter specific form of the invention, when the antenna is in its shortest adjusted position, the lower end of the jacket 28 will be adjacent the upper end of the ferrule 20, and the length of the upper portion of the antenna above the ferrule 20 will be approximately 14 inches, whereas in the fully extended position the upper portion of the antenna above the ferrule 20 will be approximately 28 inches. The lower mast 12 in the foregoing embodiment has a length of approximately 19 inches, but of course the spring mount 32 will add a further dimension to the total length of the antenna measured from the base of the mounting member.

What is claimed is:

1. An adjustable mobile antenna comprising, in combination, a hollow tubular lower metal mast, an upper metal mast telescoped into said lower mast and longitudinally adjustable therein to vary the overall length of the antenna and thereby tune the same, locking means associated with said upper and lower masts for releasably locking said upper mast in a selected fixed position relative to said lower mast, a dielectric rod mounted to the upper end of said upper mast, and a loading coil wound on said rod.

2. An antenna as defined in claim 1 where said upper mast is formed as a solid metal rod having a hollow tubular upper end portion into which the lower end of said dielectric rod is fixedly mounted.

3. An antenna as defined in claim 1 where said loading coil is wound along substantially the entire length of said dielectric rod with the turns substantially against one another to achieve minimum pitch, the lower end of said loading coil being electrically connected to said upper mast adjacent the upper end thereof.

4. An antenna as defined in claim 1 where said dielectric rod is made of fiberglass, and a protective jacket is formed over the outside of said loading coil along the entire length of said rod.

5. An antenna as defined in claim 1 where the upper end of said lower metal mast is tapered radially inwardly and formed as a split collet, said locking means comprising said split collet together with an internally threaded ferrule which is threaded down on the upper end of said lower mast to cause said collet to clamp said upper metal mast in a selected position relative to said lower mast.

6. An antenna as defined in claim 1 where said upper and lower masts are made of chrome-plated brass, and said dielectric rod is made of fiberglass.

7. An adjustable mobile antenna comprising, in combination, a hollow tubular lower metal mast, an upper metal mast formed as a solid rod having a hollow tubular upper end portion, said upper metal mast being telescoped into said lower metal mast and longitudinally adjustable therein to vary the overall length of the antenna and thereby tune the same, locking means associated with said upper and lower masts for releasably locking said upper mast in a selected fixed position relative to said lower mast, a fiberglass rod having its lower end fixedly mounted in said hollow tubular upper end portion of said upper mast, a loading coil wound on said fiberglass rod, and a protective jacket formed over the outside of said loading coil along the entire length of said fiberglass rod.

8. An antenna as defined in claim 7 where said loading coil is wound along substantially the entire length of said fiberglass rod with the turns substantially against one another to achieve minimum pitch, the lower end of said loading coil being electrically connected to said upper mast adjacent the upper end thereof.

9. An antenna as defined in claim 7 where the upper end of said lower metal mast is tapered inwardly and formed as a split collet, said locking means comprising said split collet together with an internally threaded ferrule which is threaded down on the upper end of said lower mast to cause said collet to clamp said upper mast in a selected position relative to said lower mast.

10. An adjustable mobile antenna comprising, in combination, a hollow tubular lower metal mast, an upper metal mast formed as a solid rod having a hollow tubular upper end portion, said upper metal mast being telescoped into said lower metal mast and adjustable longitudinally therein to vary the overall length of the antenna and thereby tune the same, the upper end of said lower metal mast being tapered inwardly and formed as a split collet, an internally threaded ferrule threaded down on the upper end of said lower mast to cause said collet to clamp said upper mast in a selected position relative to said lower mast, a fiberglass rod having its lower end fixedly mounted in said hollow tubular upper end portion of said upper mast, a loading coil wound along substantially the entire length of said fiberglass rod with the turns substantially against one another to achieve minimum pitch, the lower end of said loading coil being electrically connected to said upper mast adjacent the upper end thereof, and a protective jacket formed over the outside of said loading coil along the entire length of said fiberglass rod.

* * * * *